US005974703A

United States Patent [19]

Cadarette

[11] Patent Number: 5,974,703

[45] Date of Patent: Nov. 2, 1999

[54] DRAG-ALONG SNOW PLOW APPARATUS

[76] Inventor: Robert N. Cadarette, 9858 W. Long Lake Rd., Alpena, Mich. 49707

[21] Appl. No.: 09/010,164

[22] Filed: Jan. 21, 1998

[51] Int. Cl.[6] ..... E01H 5/06

[52] U.S. Cl. ..... 37/269; 37/278; 37/285; 172/329; 172/684.5

[58] Field of Search ..... 37/278, 269, 272, 37/274, 285, 268; 172/684.5, 816, 329, 351, 26.5; 280/19, 24

[56] References Cited

U.S. PATENT DOCUMENTS

| | | | |
|---|---|---|---|
| 293,569 | 2/1884 | Filbert | 37/268 |
| 350,327 | 10/1886 | Stauffer | 37/272 X |
| 509,811 | 11/1893 | Jones | 37/278 X |
| 731,419 | 6/1903 | Wykoff | 37/278 X |
| 821,660 | 5/1906 | Masten et al. | 37/269 |
| 956,896 | 5/1910 | Gross | 37/278 X |
| 1,872,082 | 8/1932 | Hedberg | 37/278 |
| 2,014,783 | 9/1935 | Schubert | 37/278 X |
| 2,022,393 | 11/1935 | Weeks | 37/272 X |
| 2,345,460 | 3/1944 | Coderre | 37/269 X |
| 2,431,410 | 11/1947 | Maxim | 37/272 X |
| 3,760,516 | 9/1973 | Billingsley . | |
| 3,807,065 | 4/1974 | Billingsley . | |
| 3,810,320 | 5/1974 | Siebert . | |
| 3,893,248 | 7/1975 | Young | 172/26.5 X |
| 3,994,081 | 11/1976 | Middleton . | |
| 4,020,587 | 5/1977 | Cuhel . | |
| 4,125,950 | 11/1978 | Mashford . | |
| 4,512,091 | 4/1985 | Leininger et al. | 37/278 |
| 4,512,415 | 4/1985 | Jennette | 172/360 |
| 4,597,202 | 7/1986 | Weeks | 37/272 X |
| 4,776,115 | 10/1988 | Nicodemus et al. | 37/231 |
| 4,796,367 | 1/1989 | Kulat | 37/278 X |
| 4,910,893 | 3/1990 | Asay | 37/285 X |
| 5,271,624 | 12/1993 | Sciortino | 273/411 |
| 5,284,211 | 2/1994 | Tozer | 172/684.5 X |
| 5,511,328 | 4/1996 | Fingerer et al. | 37/285 |
| 5,581,915 | 12/1996 | Lobato | 37/285 |

FOREIGN PATENT DOCUMENTS

| | | | |
|---|---|---|---|
| 45388 | 7/1928 | Norway | 37/269 |
| 90509 | 12/1957 | Norway | 37/285 |
| 468772 | 4/1969 | Switzerland | 37/269 |
| 2616 | of 1802 | United Kingdom | 37/269 |

*Primary Examiner*—Christopher J. Novosad
*Attorney, Agent, or Firm*—Gifford, Krass, Groh, Sprinkle, Anderson & Citkowski, P.C.

[57] ABSTRACT

A drag-along snow apparatus for use upon a snow covered ground surface. The snow plow apparatus includes a first substantially planar and elongate extending member and a second substantially planar and elongate extending member which are interconnected along a common vertical edge and which form, in combination, a substantially V-shaped configuration. First and second planar and horizontally arrayed cross members extend between the first and second elongate extending members and brace the connection between the elongate extending members. A length of rope is secured to the plow apparatus via a looped end which extends successively through a first rope support aperture located at a forward end of said elongate extending member and a second rope support aperture located at a forward end of said second elongate extending member. The rope permits a user to drag the plow apparatus along a snow covered ground surface. A vertically extending shaft extends in a parallel and inwardly spaced relationship relative to the common vertical edge of the plow apparatus. The shaft is journalled within a plurality of supports and provides the user with the ability to pivot the plow apparatus in a controlled manner during translational motion. A bottom and outwardly flared edge extends in continuous fashion and along an exterior facing surface of the first and second planar and elongate extending members, the flared edge forming a lip which facilitates in pushing the snow outwardly and away from the plow during translational motion.

11 Claims, 1 Drawing Sheet

DRAG-ALONG SNOW PLOW APPARATUS

BACKGROUND OF THE INVENTION

1. Field of the Invention

The present invention relates generally to snow plows and snow plow apparatuses and, more particularly, to a drag-along snow plow for use in clearing a snow covered path, the snow plow being particularly useful as a children's toy.

2. Description of the Prior Art

Numerous types of snow plow and snow shovel devices are known in the art for removing volumes of snow which have accumulated upon walkways, streets and driveways. The most common type of snow removal apparatus is the snow shovel which includes a planar shaped scooping surface and which is connected to an elongate handle such that, upon pushing the scooping surface along a horizontal ground surface, volumes of snow accumulate upon the scooping surface and are capable of being redeposited away from the surface which is desired to be cleared. The prior art additionally discloses other types of snow plow removal devices, particulary in the form of plowing devices which are mounted to the forward ends of vehicles such as trucks.

An additional example of a hand-operated plow devices is illustrated in U.S. Pat. No. 4,512,091, issued to Leininger et al., which discloses a wheeled snow plow scoop having a generally outwardly V-shaped configuration and a U-shaped handle pivotally secured to the side portions of the frame. An additional example of a hand-operated plow is also illustrated in U.S. Pat. No. 5,511,328, issued to Fingerer et al., which teaches a hand-operated snow plow with adjustable blades for plowing snow. A blade adjustment mechanism is located at a hingedly pivoting connection between the pair of opposed blades and permits the angular increment established between the blades to be adjusted. Numerous other types of wheeled and mechanically affixed snow plows and scoops are also known in the prior art.

SUMMARY OF THE PRESENT INVENTION

The present invention is a snow plow apparatus for use upon a snow covered ground surface, particulary as both an entertaining and functional toy for a child in which the child can clear accumulated snow from a walkway or driveway surface. The plow apparatus is likewise useful as a fully functional snow shovel for use by either a child or adult in removing such accumulations of snow.

The snow plow apparatus includes a first substantially planar and elongate extending member and a second planar and elongate extending member. The elongate extending members are interconnected along a common vertical and forward edge such that the plow forms a V-shaped configuration. A bracing assembly includes a first cross member and a second cross member extending between the V-shaped arrayed first and second planar and elongate extending members. A length of rope is secured to and extends from the plow apparatus in proximity to the forward vertical edge. The rope includes a looped end which extends successively through a first rope support aperture located at a forward end of the first elongate member and a second rope support aperture located at a forward end of the second elongate member.

The rope permits the plow to be dragged along the snow covered ground surface and the plow additionally includes a vertically extending shaft extending in a parallel and inwardly spaced relationship relative to the common vertical edge. The shaft is journalled within a plurality of vertically spaced apart supports and functions to facilitate pivoting and turning of the U-shaped plow as it is translating in dragging fashion. In one of two alternating embodiments, the shaft may include a further aperture formed therethrough and which is in alignment with the first and second rope support apertures located in the first and second elongate extending members for receiving the looped end of the rope or the looped end of the rope may curl around a rear rounded surface of the shaft.

A still additional feature of the snow plow apparatus includes a bottom and outwardly flared edge which extends in continuous fashion and along an exterior facing surface of the first and second planar and elongate extending members. The outwardly flared edge forms an extending lip portion which serves to assist in pushing the accumulated snow outwardly and away from the ground surface.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENTS

Referring to FIGS. 1, 2, 3 and 4, a drag-along snow plow apparatus for use in clearing accumulations of snow from walkways is illustrated at 10 according to the present invention. As previously explained, the snow plow apparatus 10 is particularly useful in assisting in the clearing of snow from walkways while concurrently functioning as a children's novelty toy and it is understood that the apparatus can be employed both as a children's toy and a functional snow removal device.

Figure 4:
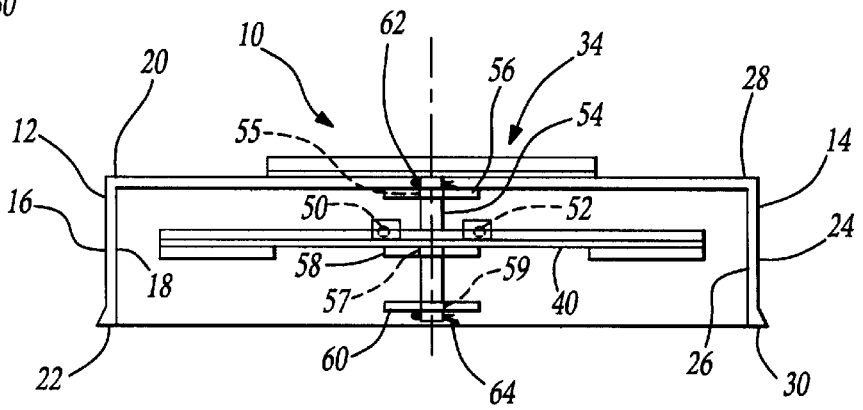
FIG. 4 is a rear view of the open interior of the V-shaped snow plow apparatus and illustrating the first and second cross members from another perspective as well as the vertically extending and journalled shaft for facilitating pivoting of the apparatus according to the present invention.

The snow plow apparatus 10 includes a first substantially planar shaped and elongate extending member 12 and a second substantially planar shaped and elongate extending member 14. The elongate extending members 12 and 14 are each substantially rectangular shape in construction with both outwardly and inwardly facing planar surfaces, bottom extending edges and top extending edges. Specifically, and as is best illustrated in FIG. 4, the first elongate extending member 12 includes an outer surface 16, and inner surface 18, a top edge 20 and a bottom edge 22 and the second elongate extending member 14 includes an outer surface 24, an inner surface 26, a top edge 28 and a bottom edge 30.

The first elongate extending member 12 and second elongate extending member 14 are arrayed in vertically oriented fashion as illustrated in the drawings and interconnect along a common vertical and forward edge 32 such that the members 12 and 14 form, in combination, a substantially V-shaped configuration. A bracing assembly is also incorporated into the snow plow to reinforce the integrity of the arrayed members 12 and 14 and includes a first planar and horizontally arrayed cross member 34 which extends between a forward location of the V-shaped arrayed members and secures at 36 to the top edge 20 of the first member 12 and at 38 to the top edge 28 of the second member 14. A second planar and horizontally arrayed cross member 40 extends rearwardly of the first cross member 34 and between an intermediate location of the members 12 and 14 and secures at an edge 42 to the inner surface 18 of the first member 12 and at an edge 44 to the inner surface 26 of the second member 14. In a preferred embodiment, pluralities of mounting bolts (see at 45) are employed for securing the cross members to the top edges and inwardly facing surfaces, respectively, of the first 12 and second 14 elongate extending members. It is also anticipated that holes can be drilled at the overlapping portions of the cross members and elongate extending side members and such known means are known in the art for facilitating the bracing of the members 12 and 14. Referring again to FIG. 1, a length of rope 46 is provided and includes a looped end 48 for securing to the plow apparatus 10. A first rope support aperture 50 is located at a forward end of the first elongate extending member 12 and a second rope support aperture 52 is located at a forward end of the second elongate extending member 14 in proximity to the vertically extending edge 32. The apertures 50 and 52 receive the looped end 48 of the rope 46 and facilitate the dragging of the snow plow along the bottom edges 22 and 30 vis-a-vis the snow covered ground surface (not shown) upon which it is desirable to clear a path, surface or walkway.

A vertically extending shaft 54 is provided extending in parallel and inwardly spaced relationship relative to the common vertical edge 32 of the plow assembly 10. The shaft 54 is journalled within a first upper support 56, a second middle support 58 and a third lower support 60, the supports securing to the members 12 and 14 proximate the forward and common vertical edge 32. For purposes of more efficient construction, it is possible to secure the supports 56, 58 and 60 in alternating fashion to the first member 12 and second member 14, such as by securing the upper support 56 and lower support 60 to the first member 12 only and in turn securing the middle member 58 to the second member 14 only through the use of bolt fasteners and the like. The spaced apart supports include aligned apertures 55, 57 and 59, respectively, through which the shaft 54 extends. Viewing FIGS. 1 and 4 in combination, it is further illustrated that pins are employed to retain the shaft in position vis-a-vis the supports 56, 58 and 60 and this includes an upper pin 62 (see FIG. 1) and a lower pin 64 (see FIG. 4). Cotter pins are most desirously employed for the pins 62 and 64, however it is understood that many other suitable types of rotatably and isolatingly positioning means can be employed as are known in the art.

In one of two further embodiments, the loop portion 48 of the rope further extends through an aperture 66 (see FIG. 3) formed in the shaft 54 and which is in alignment with the first and second rope support apertures 50 and 52. In the other embodiment, it is possible that the looped portion 48 of the rope 46 may curve around the rear curved surface of the shaft 54 intermediate the first and second rope support apertures 50 and 52.

Figure 1:
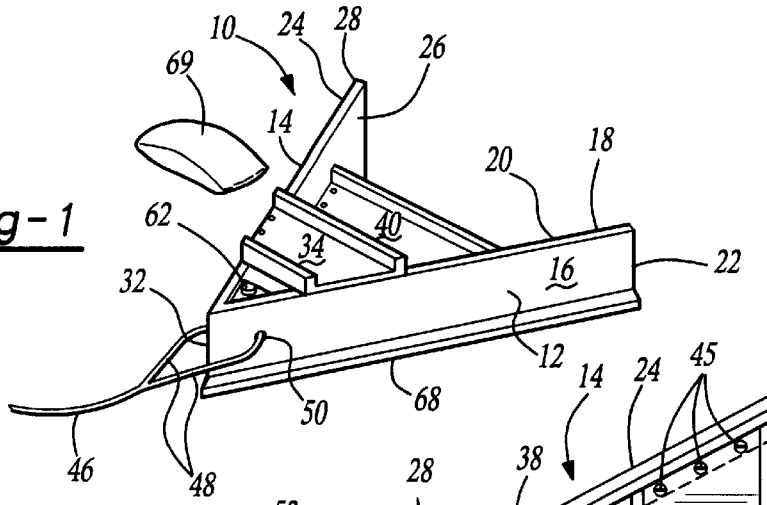
FIG. 1 is a perspective view of the drag-along snow plow apparatus according to the present invention.
Figure 2:
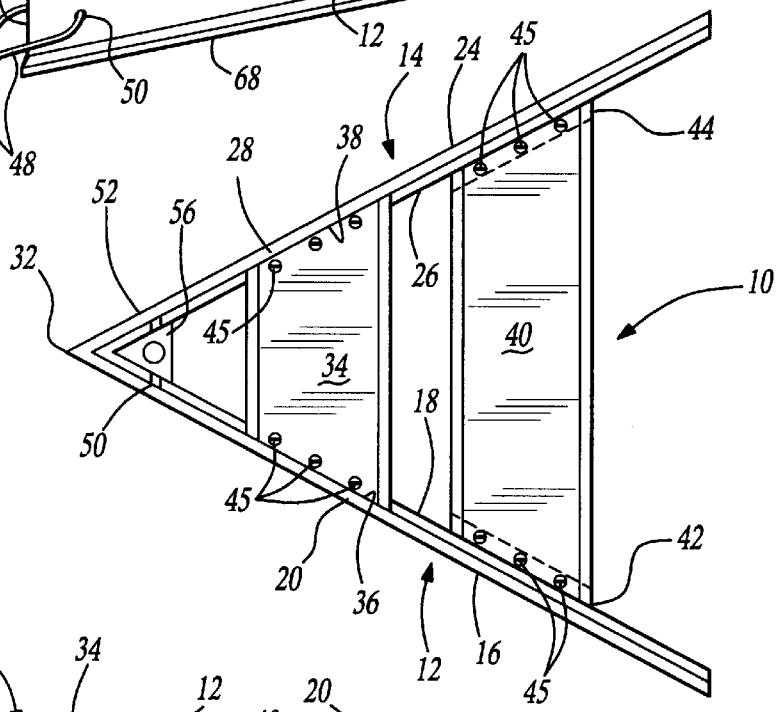
FIG. 2 is a top view of the snow plow apparatus as substantially illustrated in FIG. 1.
Figure 3:
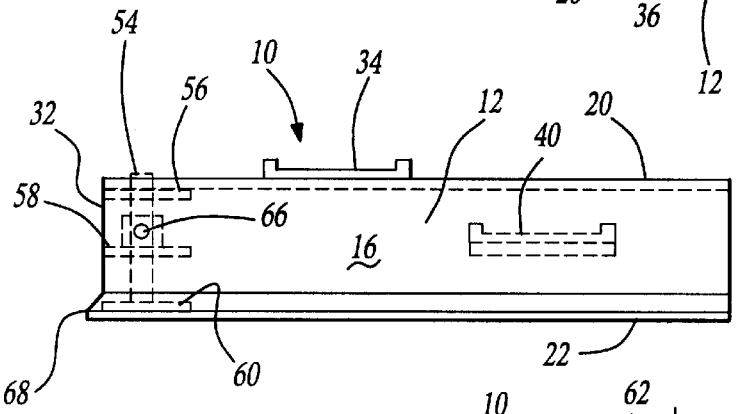
FIG. 3 is a side view of the snow plow apparatus according to the present invention with the first and second cross members illustrated in phantom.

In use, the snow plow apparatus 10 is translating along the ground surface by the user (not shown) grasping the rope 46 and pulling so that the bottom edges 22 and 30 of the elongate extending members 12 and 14 are in scraping and engaging contact with the ground surface. Also provided along the bottom edges 22 and 30 is an outwardly flared edge or lip portion 68 which extends continuously around the first and second members 12 and 14 and which assists in collecting and outwardly deflecting accumulated snow. An optional provision at 69 in FIG. 1 is for a bag of a weighted substance including sand, gravel, dirt or salt to be positioned upon the forward edge 32 of the apparatus to assist in holding the forward edge of the plow to the ground during clearing of the snow. Such bags are typically provided in the 20 to 40 pound variety and are known in the art.

Additional preferred embodiments contemplate constructing the first and second elongate extending members and cross members of wood which are integrally constructed with the use of the fasteners. It is also envisioned that the structure of the snow plow assembly according to this invention could be reproduced within a suitable injection mold and such that the extending members and cross members are constructed of an injection molded polymer or plastic material.

Having described my invention, additional embodiments will become apparent to those skilled in the art to which it pertains without deviating from the scope of the appended claims.

I claim:

1. A snow plow apparatus for use upon a snow cover ground surface, said snow plow apparatus comprising:

a first substantially planar and elongated extending member and a second substantially planar and elongate extending member, said first and second planar and elongate extending members interconnecting along a common vertical edge and forming, in combination, a substantially V-shaped configuration;

bracing means extending between said first elongate extending member and said second elongate extending member; and drag-along means extending from apertures inwardly spaced from said common vertical edge of said snow plow and securing means for attaching said drag-along means to said snow plow, said drag-along means facilitating translating motion of said snow plow along the snow covering ground surface. said drag-along means further comprising a length of rope and said securing means further comprising a looped end of said length of rope which extends through a first rope support aperture located at a forward end of said first elongate supporting member. said looped end extending through a second rope support aperture at a forward end of said second elongate extending member, said securing means further comprising a vertically extending shaft extending in a parallel and inwardly spaced relationship relative to said common vertical edge, said shaft being journalled within a plurality of vertically spaced apart supports secured to said forward ends of said elongate extending members, said spaced apart supports each including an aligned aperture through which said shaft extends, said vertically extending shaft including an aperture formed therethrough which is in alignment with said first and second rope support apertures and through which said looped end of said rope extends.

2. The snow plow apparatus according to claim 1, further comprising a first upper support, a second middle support and a third lower support within which said shaft is journalled.

3. The snow plow apparatus according to claim 2, further comprising a first pin intersecting an upper end of said shaft and a second pin intersecting a lower end of said shaft, said first and second pins maintaining said shaft in vertically located and journalled relationship within said supports.

4. The snow plow apparatus according to claim 3, wherein said first and second pins further comprise upper and lower cotter pins.

5. The snow plow apparatus according to claim 1, said bracing means further comprising a first planar and horizontally arrayed cross member, said first cross member securing to and extending between a forwardly located and top edge surface of said first planar shaped and elongate extending member and a likewise forwardly located and top edge surface of said second planar shaped and elongate extending member.

6. The snow plow apparatus according to claim 5, said bracing means further comprising a second planar and horizontally arrayed cross member, said second cross member securing to and extending between an intermediately located and inwardly facing surface of said first planar shaped and elongate extending member and a likewise intermediately located and inwardly facing surface of said second planar shaped and elongate extending member.

7. The snow plow apparatus according to claim 6, further comprising pluralities of bolt fasteners for securing said first and second cross members to said first and second planar and elongate extending members.

8. The snow plow apparatus according to claim 1, further comprising a bottom and outwardly flared edge extending in continuous fashion and along an exterior facing surface of said first and second planar and elongate extending members.

9. The snow plow apparatus according to claim 1, wherein said snow plow is established as a body and is constructed of wood.

10. The snow plow apparatus according to claim 1, wherein said snow plow is established as a one-piece integral body and is constructed of an injection molded polymer or plastic material.

11. The snow plow apparatus according to claim 1, further comprising a bag of a weighted substance capable of being positioned upon said snow plow.

* * * * *